US005374170A

United States Patent [19]

Shimizu et al.

[11] Patent Number: 5,374,170

[45] Date of Patent: * Dec. 20, 1994

[54] SCREW VACUUM PUMP

[75] Inventors: Noburu Shimizu; Kiyoshi Yanagisawa, both of Kanagawa, Japan

[73] Assignee: Ebara Corporation, Tokyo, Japan

[ * ] Notice: The portion of the term of this patent subsequent to May 24, 2011 has been disclaimed.

[21] Appl. No.: 907,035

[22] Filed: Jul. 1, 1992

[30] Foreign Application Priority Data

Jul. 10, 1991 [JP] Japan ..... 3-195945

[51] Int. Cl.[5] ..... F04C 18/16; F04C 25/02

[52] U.S. Cl. ..... 418/9; 418/201.1

[58] Field of Search ..... 418/201.1, 201.2, 9

[56] References Cited

U.S. PATENT DOCUMENTS

| | | | |
|---|---|---|---|
| 3,088,659 | 5/1963 | Nilsson et al. | 418/201.2 |
| 4,068,984 | 1/1978 | Spindler | 418/201.1 |
| 4,220,197 | 9/1980 | Schaefer et al. | 165/35 |
| 4,667,646 | 5/1987 | Shaw | 418/201.2 |
| 5,051,077 | 9/1991 | Yanagisawa et al. . | |

FOREIGN PATENT DOCUMENTS

| | | | |
|---|---|---|---|
| 60-216089 | 10/1985 | Japan . | |
| 61-152990 | 7/1986 | Japan . | |
| 0205388 | 9/1986 | Japan | 418/201.1 |
| 61-223295 | 10/1986 | Japan . | |
| 61-234290 | 10/1986 | Japan . | |
| 22948 | 1/1990 | Japan . | |
| 27268 | 2/1990 | Japan . | |
| 747058 | 3/1956 | United Kingdom . | |
| 2077951 | 12/1981 | United Kingdom . | |
| 2193534 | 2/1988 | United Kingdom . | |
| 1146482 | 3/1985 | U.S.S.R. | 418/201.1 |

OTHER PUBLICATIONS

Patent Abstracts of Japan, vol. 12, No. 169 (M-699), May 1988, & JP-A-62 284 994, Dec. 10, 1987, Tsuru Seiji, et al., "Method for Starting Multistage Screw Vacuum Pump".

*Primary Examiner*—Richard A. Bertsch
*Assistant Examiner*—Charles G. Freay
*Attorney, Agent, or Firm*—Oblon, Spivak, McClelland, Maier & Neustadt

[57] ABSTRACT

To provide a screw vacuum pump which is compact and yet capable of attaining a high degree of vacuum. A screw vacuum pump having a pair of male and female rotors 7 and 7A rotating in mesh with each other around two parallel axes, respectively, and a casing 1 for accommodating the two rotors 7 and 7A, the casing 1 having a suction port 8b and a discharge port 9b, the screw vacuum pump further having a process of sucking a gas from the suction port 8b into a space defined between the rotors 7 and 7A, a process of transferring the gas, a process of compressing the gas, and a process of discharging the gas from the discharge port 9b, wherein the suction port 8b is closed early, thereby providing an expansion process between the suction and transfer processes.

5 Claims, 1 Drawing Sheet

SCREW VACUUM PUMP

BACKGROUND OF THE INVENTION

The present invention relates to a screw vacuum pump and, more particularly, to a screw vacuum pump which is designed so that it is possible to raise the ultimate pressure.

There has heretofore been one type of screw vacuum pump which has a pair of male and female rotors rotating in mesh with each other around two parallel axes, respectively, and a casing for accommodating the two rotors, the casing having a suction port and a discharge port. This type of pump includes:

(A) screw vacuum pumps which have a process of sucking a gas from the suction port into a space defined between the rotors, and a process of compressing the gas inside the rotors; and (B) screw vacuum pumps which have a process of transferring the sucked gas between the suction and compression processes.

All the above-described conventional screw vacuum pumps are arranged such that the suction port is closed when the space volume reaches a maximum. The type (A) of screw vacuum pump suffers from the problem that since the number of groove spaces present between the discharge and suction ports is small, the gas leaks to the suction side, and it is therefore impossible to attain a high degree of vacuum. In the type (B) of screw vacuum pump, the rotor wrap angle is increased (i.e., the rotor length is increased) to provide a transfer section inside the rotors, thereby increasing the number of groove spaces present between the discharge and suction ports. Therefore, this type of screw vacuum pump has the disadvantage that the axial length of the rotors increases, resulting in an increase in the overall size of the pump, although a high degree of vacuum can be attained.

SUMMARY OF THE INVENTION

In view of the above-described circumstances, it is an object of the present invention to eliminate the above-described problems and provide a screw vacuum pump which is compact and yet capable of attaining a high degree of vacuum.

To solve the above-described problems, the present invention provides a screw vacuum pump having a pair of male and female rotors rotating in mesh with each other around two parallel axes, respectively, and a casing for accommodating the two rotors, the casing having a suction port and a discharge port, the screw vacuum pump further having a process of sucking a gas from the suction port into a space defined between the rotors, a process of transferring the gas, a process of compressing the gas inside the rotors, and a process of discharging the gas from the discharge port, wherein the suction pore is closed early, thereby inserting a process of expanding the sucked gas between the suction and transfer processes, and thus shortening the transfer section and hence shortening the rotor length.

In addition, tile present invention is characterized in that a plurality of screw vacuum pumps having the above-described arrangement are connected in series to form a multi-stage screw vacuum pump.

In addition, the present invention provides a multi-stage screw vacuum pump having the above-described arrangement, which is characterized in that the pumping speed of each screw vacuum pump is either approximately equal to or higher than that of the preceding screw vacuum pump.

In the above-described screw vacuum pump, it is essential in order to attain a high degree of vacuum to provide as many groove spaces as possible in between the discharge and suction ports and increase the number of seal lines to thereby reduce the leakage of gas to the suction port during the compression process. In the present invention, tile number of groove spaces is increased by closing the suction port early, thereby providing an expansion process between the suction and transfer processes. Therefore, the transfer section can be shortened (in other words, the rotor length can be shortened). In addition, groove spaces where the pressure is lower than the suction pressure are provided in between the suction port and groove spaces undergoing the transfer and compression processes. Accordingly, it is possible to prevent leakage of gas to the suction port more effectively than in the case of the prior art.

If screw vacuum pumps having the above-described arrangement and operation are connected in series in a multi-stage structure, a high degree of vacuum can be attained. In addition, if the pumping speed of each vacuum pump is set to be approximately equal to or higher than that of the preceding vacuum pump, there will be no rise in the gas in a passage connecting a pair of adjacent pumps at the time, for example, of evacuation of a gas of atmospheric pressure. Thus, it is possible to prevent the driving machine from being overloaded and hence possible to improve the reliability of the vacuum pump.

DETAILED DESCRIPTION OF THE PREFERRED EMBODIMENTS

Figure 2:
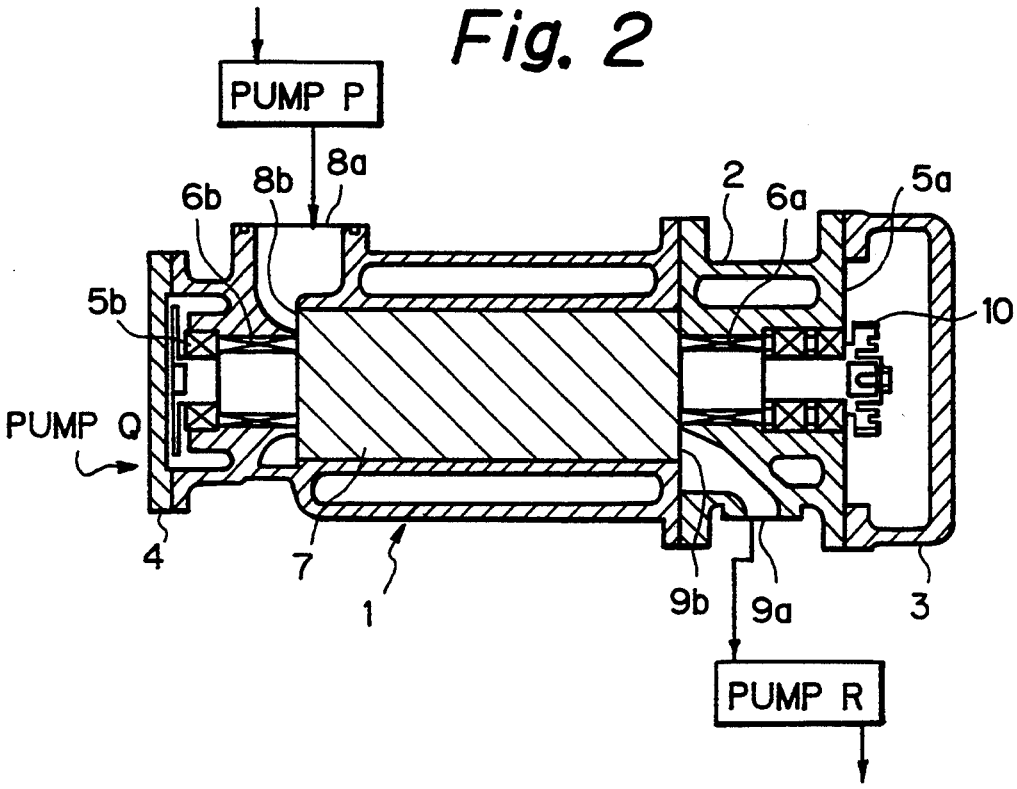
FIG. 2 is a sectional side view showing the structure of the screw vacuum pump according to the present invention.

Embodiments of the present invention will be described below with reference to the accompanying drawings. FIG. 2 is a sectional side view showing the structure of the screw vacuum pump according to the present invention. The screw vacuum pump has a main casing 1, a discharge casing 2, and a pair of male and female rotors 7 and 7A, which are rotatably supported by respective bearings **5*a* and 5*b* in a space defined between the main and discharge casings 1 and 2. The male and female rotors 7 and 7A are sealed off from lubricating oil used for the bearings 5*a* and 5*b* by respective shaft seals 6*a* and 6*b***.

In the meantime, for example, the male rotor 7 is rotated by an electric motor (not shown) through a speed change gear (not shown), while the female rotor 7A is rotated through a timing gear 10 with a small clearance between the same and the male rotor 7.

A gas that is sucked in from a suction opening **8*a* is introduced through a suction port 8*b* into a groove space that is defined by the main casing 1 and the two rotors 7 and 7A. That is, the gas undergoes suction and compression processes and is then discharged from a discharge opening 9*a* through a discharge port 9*b*. More specifically, the gas undergoes a process for sucking the gas from the suction port 8b into a groove space defined by the rotors 7 and 7A, a process for expanding the gas sucked, a process for transferring the gas, and a process for compressing the gas inside the rotors 7 and 7A, and the gas is then discharged from the discharge opening 9a through the discharge port 9b**.

Figure 1:
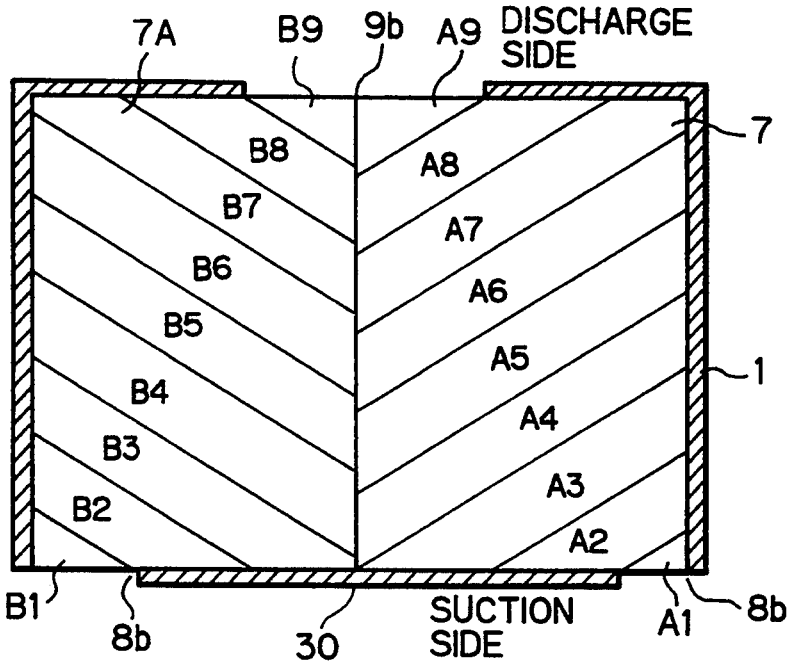
FIG. 1 shows the way in which a pair of male and female rotors are in mesh with each other in a view developed in the circumferential direction of the rotors.

FIG. 1 shows the way in which the male and female rotors 7 and 7A are in mesh with each other in a view developed in the circumferential direction of the rotors. In FIG. 1, reference symbols A1 to A9 and B1 to B9 denote pairs of corresponding groove spaces of the rotors 7 and 7A. The groove spaces A1 and B1 are undergoing the process of sucking the gas from tile suction port 8b; the groove spaces A2, A3, B2 and B3 are undergoing the process of expanding the gas sucked; the groove spaces A4, A5, A6, B4, B5 and B6 are undergoing the process of transferring the gas; the groove spaces A7, A8, B7 and B8 are undergoing the process of compressing the gas; and the groove spaces A9 and B9 are undergoing the process of discharging the gas from the discharge port 9b.

As shown in FIG. 1, in the screw vacuum pump of this embodiment, the size of a wall portion 30 of the main casing 1 is increased so that the suction port 8b is closed early, thereby increasing tile number of groove spaces between the suction and discharge ports, and thus providing the groove spaces A2, A3, B2 and B3, which are in the expansion process, and the groove spaces A4, A5, A6, B4, B5 and B6, which are in the transfer process, in between the groove spaces A1 and B1, which are in the suction process, and the groove spaces A7, A8, B7 and B8, which are in the compression process. More specifically, in the screw vacuum pump of this embodiment the suction port is closed early, thereby increasing the number of groove spaces, that is, providing the groove spaces A2, A3, B2 and B3, without increasing the rotor length between the discharge and suction ports 9b and 9a. Therefore, even if the number of groove spaces which are in the transfer section is reduced by shortening the rotor length, it is possible to ensure the same number of groove spaces as that in the prior art in between tile discharge and suction ports 9b and 9a. Thus, the screw vacuum pump can be made compact without lowering the performance.

In addition, groove spaces (that is, the groove spaces A2, A3, B2 and B3, which are in the expansion process, and the groove spaces A4, A5, A6, B4, B5 and B6, which are in the transfer process) where the pressure is lower than the suction pressure are provided in between the suction port 8b and groove spaces (that is, the groove spaces A7, A8, B7 and B8) undergoing the compression process. Accordingly, It is possible to prevent leakage of gas to the suction port 8b more effectively than in the case of the prior art.

Although the above-described embodiment shows the arrangement and operation of a single screw vacuum pump, it should be noted that a plurality of screw pumps P, Q and R having the above-described arrangement may be arranged in series to form a multi-stage screw vacuum pump by connecting the suction opening of each pump to the discharge opening of the preceding one. With this arrangement, a high degree of vacuum can be attained.

In the case of such a multi-stage screw vacuum pump, the pumping speed of each screw vacuum pump is set to be either approximately equal to or higher than that of the preceding pump. With this arrangement, there is no occurrence of such an undesirable phenomenon that the gas is compressed between a pair of adjacent vacuum pumps at the time, for example, of evacuation of a gas of atmospheric pressure. Thus, there is no possibility of each vacuum pump being overloaded.

As has been described above, according to the present invention the suction port is closed early, thereby increasing the number of groove spaces, and thus inserting an expansion process in between the suction and transfer processes. Therefore, it is possible to obtain the following advantageous effects:

(1) The rotor length shortens, and the pump becomes compact. In addition, it is possible to provide groove spaces where the pressure is lower than the suction pressure in between the suction pore and groove spaces undergoing the compression process. Accordingly, the leakage of gas to the suction port can be prevented more effectively than in the case of the prior art, and a higher degree of vacuum can be attained.

(2) If screw vacuum pumps having the above-described arrangement and operation are connected in series in a multi-stage structure, a high degree of vacuum can be attained.

(3) If the pumping speed of each vacuum pump is set to be approximately equal to or higher than that of the preceding vacuum pump, there is no possibility of each vacuum pump being overloaded, and a higher degree of vacuum can be attained.

What is claimed is:

1. A screw vacuum pump having male and female rotors rotating in mesh with each other around two parallel axes, respectively, and a casing for accommodating said two rotors, said casing having a suction port and a discharge port, said screw vacuum pump further having a process of sucking a gas from said suction port into a space defined between said rotors, a process of transferring said gas without expansion, compression or discharge, a process of compressing said gas inside said rotors, and a process of discharging said gas from said discharge port, wherein said suction port is so sized and shaped as to close early, thereby inserting a process of expanding the sucked gas between said suction and transfer processes.

2. A screw vacuum pump comprising:

a casing having a suction port at one end and a discharge port at another end; and two rotatable rotors in said casing, said rotors each having spiral groove spaces which mesh to transport gasses in said groove space between said ends of said casing when said rotors are rotated in synchronism;

wherein said suction port is so positioned at said one end as to communicate with said groove spaces as volumes of said groove spaces are increasing when said rotors are rotated to transport the gasses from said one end toward said another end, and wherein said suction port is so sized and shaped as to end communication with each one of said groove spaces at a time before a volume of the one of the groove spaces has reached a maximum value, so that gasses in said groove spaces are expanded, and wherein said rotors have sufficient length to provide a transport process in which gases in said groove spaces are transported therein without being expanded, compressed or discharged.

3. A pump apparatus comprising a plurality of screw vacuum pumps connected in series to form a multi-stage structure, each of said screw vacuum pumps comprising:

a casing having a suction port at one end and a discharge port at another end; and two rotatable rotors in said casing, said rotors each having spiral groove spaces which mesh to transport gasses in said groove spaces between said ends of said casing when said rotors are rotated in synchronism;

wherein said suction port is so positioned at said one end as to communicate with said groove spaces as volumes of said groove spaces are increasing when said rotors are rotated to transport the gasses from said one end toward said another end, wherein said suction port is so sized and shaped as to end communication with each one of said groove spaces at a time before a volume of the one of the groove spaces has reached a maximum value, so that gasses in said groove spaces are expanded, and wherein said rotors have sufficient length to provide a transport process in which gases in said groove spaces are transported therein without being expanded, compressed or discharged.

4. A plurality of screw pumps, each of said screw pumps having male and female rotors rotating in mesh with each other around two parallel axes, respectively, and a casing for accommodating said two rotors, said casing having a suction port and a discharge port, at least one of said screw vacuum pumps further having a process for sucking a gas from said suction port into a space defined between said rotors, a process of transferring said gas without expansion, compression or discharge, a process of compressing said gas inside said rotors, and a process of discharging said gas from said discharge port, wherein said suction port is so sized and shaped as to close early, thereby inserting a process of expanding the suction gas between said suction and transfer processes, wherein said screw vacuum pumps are connected in series in a multi-stage structure and the pumping speed of each screw vacuum pump is either approximately equal to or higher than that of the preceding screw vacuum pump, and wherein the rate of exhaust gas of the second stage is equal to or larger than that of the first stage.

5. A pump apparatus comprising a plurality of screw vacuum pumps connected in series to form a multi-stage structure, at least one of said screw vacuum pumps comprising:

a casing having a suction port at one end and a discharge port at another end; and two rotatable rotors in said casing, said rotors each having spiral groove spaces which mesh to transport gasses in said groove spaces between said ends of said casing when said rotors are rotated in synchronism, wherein said suction port is so positioned at said one end as to communicate with said groove spaces as volumes of said groove spaces are increasing when said rotors are rotated to transport the gasses from said one end toward said another end, wherein said suction port is so sized and shaped as to end communication with each one of said groove spaces at a time before a volume of the one of the groove spaces has reached a maximum value, so that gases in said groove spaces are expanded, and wherein said rotors have sufficient length to provide a transport process in which gases in said groove spaces are transported therein without being expanded, compressed or discharged, wherein in a direction from a low pressure and to a high pressure end of said multi-stage structure, a pumping speed of each of said screw vacuum pumps is at least as great as that of a preceding screw vacuum pump, and wherein the rate of exhaust gas of the second stage is made equal to or greater than that of the first stage.

* * * * *